US006119280A

United States Patent [19]

Rentsch

[11] Patent Number: 6,119,280

[45] Date of Patent: Sep. 19, 2000

[54] ALL PLASTIC LEAK-PROOF URINAL

[75] Inventor: Hans Rentsch, Mundelein, Ill.

[73] Assignee: Medline Industries, Inc., Mundelein, Ill.

[21] Appl. No.: 08/452,153

[22] Filed: May 26, 1995

[51] Int. Cl.[7] ..... A47K 11/00

[52] U.S. Cl. ..... 4/144.1; 4/144.2

[58] Field of Search ..... 4/144.1, 144.2, 4/144.3; 215/307, 317, 355; 220/307, 375; 383/59, 60, 63, 65, 66, 67, 84, 96, 901

[56] References Cited

U.S. PATENT DOCUMENTS

| | | | |
|---|---|---|---|
| 2,777,490 | 1/1957 | Munk | 150/8 |
| 3,716,871 | 2/1973 | Borse | 4/110 |
| 4,231,486 | 11/1980 | Bock | 220/307 |
| 4,270,231 | 6/1981 | Zint | 4/144.1 |
| 4,520,793 | 6/1985 | Hall | 4/616 |
| 4,529,102 | 7/1985 | Quinn et al. | 222/94 |
| 5,422,076 | 6/1995 | Jones | 220/307 |

*Primary Examiner*—Charles R. Eloshway
*Attorney, Agent, or Firm*—Laff, Whitesel & Saret, Ltd.; J. Warren Whitesel

[57] ABSTRACT

An all plastic leak-proof, male urinal has a cap with an outstanding circumferential bead projecting therefrom. The inside of the bottle neck has a circumferential depression which receives the bead. The cap has a flat disk-like diaphragm with a reinforced area in the middle thereof. When the cap is placed over the neck and the reinforced area is pushed, the lid takes on a somewhat conical shape which causes it to slide through the neck to a location where the bead confronts the depression. The reinforced area is released and the memory of the plastic of the lid forces the bead into the depression. A handle on the bottle is spaced from the bottle to form a space which has a cove area that locks onto a rail on a hospital bed.

8 Claims, 1 Drawing Sheet

ALL PLASTIC LEAK-PROOF URINAL

This invention relates to all plastic, disposable, blow molded bottles with a leak-proof cap, and more particularly to means for capping a blow molded urinal of a type used in hospitals and hung on bed rails.

One piece, all plastic urinals are manufactured by using an extrusion blow molding process where a molten tube of plastic is dropped between two halves of a mold. The mold halves are closed onto the molten tube. Then, compressed air is injected into the molten tube forcing the walls of the tube to expand into the mold, thus taking the shape of the cavity in the mold. The mold and molten plastic are cooled so that the plastic retains the permanent shape of the mold.

When the mold halves are open, the plastic urinal is removed from the mold. A flashing of excess plastic is trimmed from the parting line where the two halves of the mold come together, including the parting line at the neck or opening end of the urinal. It is most difficult to trim consistently especially in the neck area because the flashing material is the thickest at this point. Normally, the finished product has a raised spot on the outside surface of the urinal and a depressed spot on the inside surface of the urinal. Therefore, when a cap is installed over the open end, it will not always seal properly around the raised or depressed spot so as to prevent a leakage of urine from the space between the cap and the neck of the urinal.

Since blow molding is the only practical way of making a bottle at a cost which is low enough to provide a disposable urinal, an elimination of the raised and shrink depression at the parting line is not realistic. Also, for a disposable cap, it is not practical to add any detail to the molded plastic cap, such as a rubber sealing ring, for example. Therefore, some other method of making a leak proof seal between cap and bottle is highly desired.

While the specific example give here, for convenience of description, is an all plastic urinal, it should be understood that the same principle applies to almost any device (such as a blow molded milk bottle, for example) having a less than smooth surfaces to be sealed by a molded cap. Accordingly, the invention is applicable to and the claims are to be construed to cover all equivalent structures.

Accordingly, an object of the invention is to provide a new and improved leak-proof capping of the neck of a bottle having less than a perfect internal surface for receiving the cap. In this connection, an object is to form a surface-to-surface seal which does not depend upon making a contact against the less than perfect internal surface. Here, an object is to make the described seal at the lowest possible cost in order to provide disposable products.

In keeping with an aspect of this invention, these and other objects are accomplished by a molded bottle with a depression formed circumferentially around the internal surface of the neck of a bottle, preferably at a location where a shrink depression is least likely to occur. A plastic cap is molded to have a raised circumferential detent or bead in an area which will mate with the circular depression when the cap is in place. The cap itself is a flat disk or diaphragm which has in its center a reinforced area that resists deformation. When the cap is placed over the neck of a bottle and the reinforced area is pressed, the shape of the diaphragm distorts as it becomes somewhat conical, thereby giving enough relief for the circumferential detent to slip through the neck. When the reinforced area is released, the cap returns to its flat disk shape forcing the detent into the circular depression to make a substantially leak-proof seal thereat.

A preferred embodiment of the invention is shown in the attached drawings, wherein.

Figure 1:
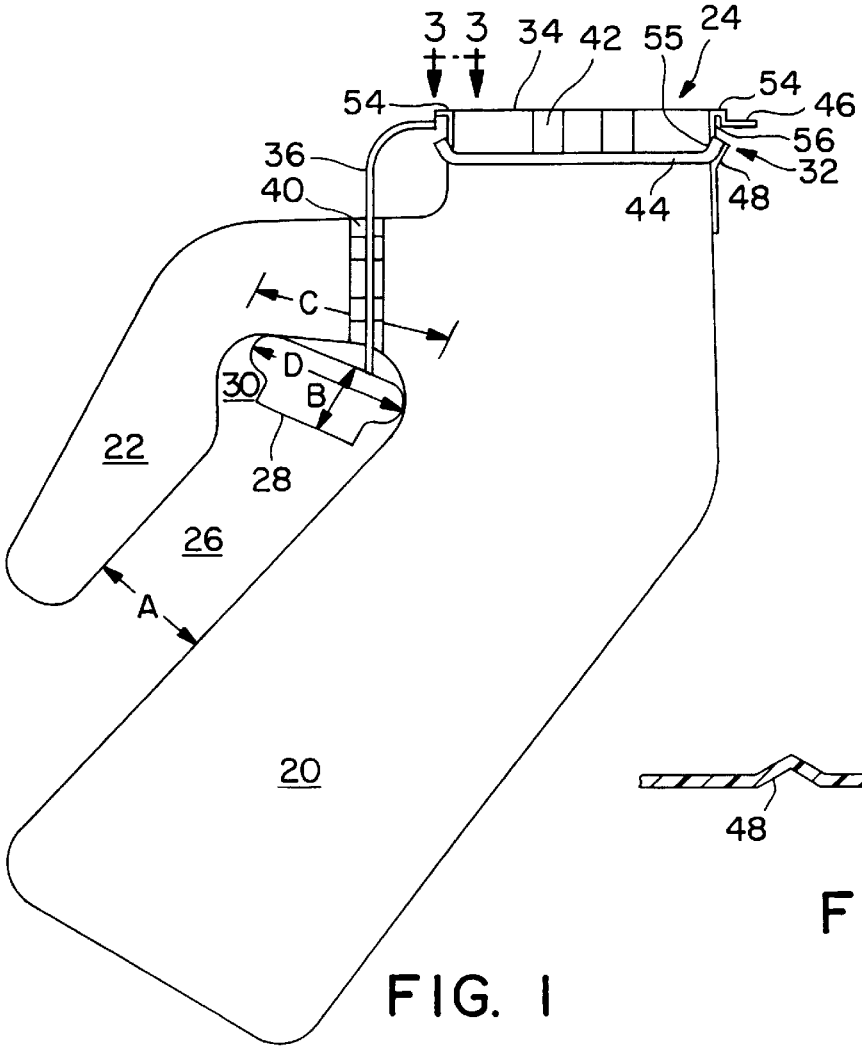
FIG. 1 is a side elevation (in cross-section) of a capped, blow molded, all plastic urinal hanging from a hospital bed rail.

An integral, all plastic bottle is shown in the form of a conventional male urinal having a body 20 with a handle 22, and a separate cap 24. The handle 22 is generally parallel to the bottle 20 leaving an open area 26 therebetween. The shape of the open area 26 has a narrow dimension A through which a narrow dimension B of a bed rail 28 may pass as it is fitted over a rail 28 on a hospital bed. Dimension C receives a wide dimension D of the rail 28 after it has passed through narrow dimension A of area 26. The dimensions of urinals and hospital bed rails are standard so that an enlarged cove area 30 may be formed at the top of the open area 26 to provide for these dimensions.

Thus, the handle 22 may be fitted over the rail while the bottle is slightly horizontal and then the bottle is released. The weight of the bottle causes it to rotate slightly so that the wide dimension D of the rail 28 becomes captured in the cove 30. To remove the bottle, the procedure is reversed. The urinal is rotated slightly into a horizontal position so that the rail 28 escapes the cove 30, and the narrow dimension B slips through the narrow dimension A of the open area 26.

These and other manipulations of the urinal may cause it to be in positions where a capped urinal could leak if the walls of the neck region 32 are less than perfect. With the prior blow molded bottle construction a cap simply snapped over or into the neck 32. There was very often an enlarged or a sunken area which formed as the plastic cooled at the parting line in the mold. Therefore, many of the prior art urinals were subject to the leaking problems which the invention overcomes.

Figure 2:
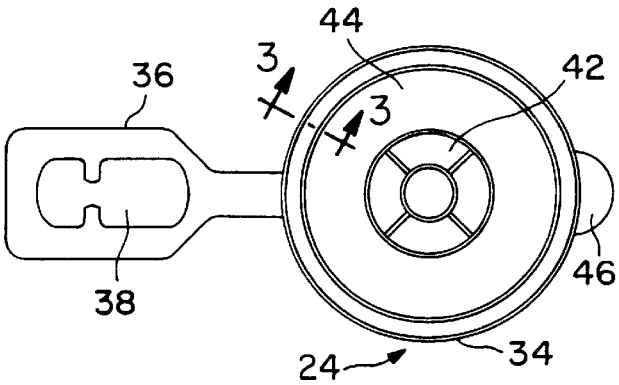
FIG. 2 is a separate, molded cap for the bottle of FIG. 1.

A cap 24 (FIG. 2) has a lid part 34 and a strap part 36 formed integrally therewith. The strap 36 included a window 38 which passes over the handle 22 and seats itself in an area 40 near the body of the bottle. The strap 36 is long enough for the lid part 34 to snap over the neck of the bottle. The lid part 34 is a flat disk 44 with a reinforced area 42 in the center thereof. The area 44 surrounding the reinforced part 42 may be thought of as behaving somewhat like a diaphragm. A tab 46 is a means for lifting the lid portion 34 from the close position and off the neck of the bottle.

The bottle is formed with a circular depressed area 48 circumferentially located around the inside surface of the neck of the bottle.

Figure 3:
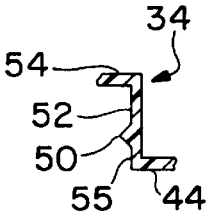
FIG. 3 is a cross-section taken along line 3—3 of FIGS. 1 and 2.

A circumferential bead 50 (FIGS. 2 and 3) is formed around an outside cylindrical surface 52 at the periphery of the lid portion 34 of the cap. The upper edge of the cylindrical portion 52 has a circumferential lip 54 projecting therefrom. When the lip 54 is firmly seated against the top of the bottle neck, the circumferential detent 50 confronts the depressed region 48 so that the two may come together to form a liquid seal.

Figure 4:
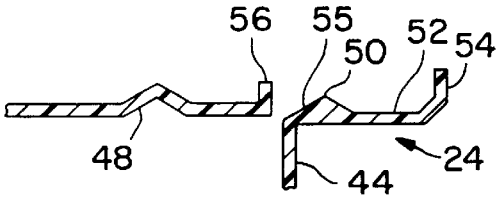
FIGS. 4–6 are three stop motion views showing the cap being inserted into the neck of the bottle.
Figure 5:
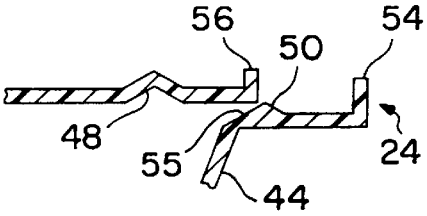
Figure 6:
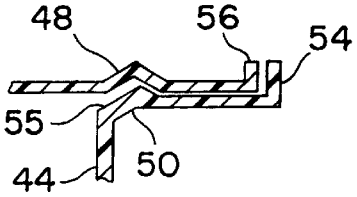

The operation of the inventive lid lock feature is shown in the three-stop motion views of FIGS. 4–6. As the lid portion 34 approached the outer edge of the bottle neck, the circumference of detent bead 50 is larger than the inside circumference of the bottle neck. However, a guiding cam surface 55 tapers from the detent bead 50 to an outside diameter which is small enough to easily enter the neck of the bottle (FIG. 5). At this point, the user presses against the reinforced area 42. This deforms the diaphragm portion 44 of the lid so that the normally flat disk 44 tends to take on a somewhat conical shape, as seen in FIG. 5. The effect is to pull in and reduce the outside diameter of the locking detent bead 50 enough to pass through the interior of the neck. When the lip 54 on cap 24 comes into contact with a lip 56 at the top of the neck on the bottle, the sliding motion stops.

When the cap is in place, the user removes the pressure from the reinforced area 42. The memory of the plastic causes the diaphragm portion 44 to resume its flat disk shape. This pushes the detent bead 50 into the circumferential depression 48 with enough force to make the seal leak-proof.

When it comes time to open the bottle, the lift tab 46 is raised. This causes the front edge of the lid portion 34 to raise. The lid curls enough to free the detent bead 50 from the depressed area 48. A continued lifting of the tab 46 causes the lid to peel away from the bottle.

Those who are skilled in the art will readily perceive how to modify the invention. Therefore, the appended claims are to be construed to cover all equivalent structures which fall within the true scope and spirit of the invention.

What is claimed is:

1. A leak-proof all plastic bottle comprising a body leading to an open neck, said neck having a circumferential depression on an inside surface of said neck, a cap having a circumferential detent bead surrounding a cylindrical surface of said cap at a location where said depression and bead confront each other when said cap is in place, a diameter of said detent bead being greater than a diameter of said inside surface of said neck, said cap having a diaphragm-like disk with a reinforced area in the center thereof, said diaphragm distorting responsive to pressure on said reinforced area to form a somewhat conical shape which reduces the diameter of said detent bead sufficiently to slide through said inside surface of said neck far enough to confront said circumferential depressed area, the memory of said plastic causing said diaphragm to return to said disk shape for driving said detent bead into said circumferential depression responsive to removal of said pressure on said reinforced area, a bed rail having a wide dimension and a narrow dimension, a handle extending from and parallel to said body, said handle being spaced from said bottle to form an open area wide enough for said narrow dimension of said bed rail to pass through when said bottle is in a first position, a cove at a point in said open area where said bottle hangs under its own weight, said cove forming an area large enough to receive the wide dimension of said bed rail whereby said bottle locks in position when hanging under its own weight and unlocks from that position when said bottle is moved from said hanging position to said first position.

2. An all plastic male urinal comprising a bottle having a body and a handle spaced therefrom by an open area having a predetermined width, a cove in the top of said open area, said cove having a rounded top and a width that is larger than said predetermined width, a hospital bed rail having a first dimension which is less than said predetermined width and having a second dimension which is less than said larger width of said cove, whereby said bed rail can pass through said open area when said bottle is in a first position, said bottle rotating relative to said rail moving under said rounded top and into said cove responsive to the weight of said bottle in order to place said larger width across said second width of said cove so that said weight of said bottle locks said bottle in place on said rail.

3. The urinal of claim 2 wherein said bottle has a neck with a circumferential depression on the inside surface of said neck, a plastic cap having a detent bead projecting around an outside circumference of said cap at a location which confronts said depression when said cap is in place in said neck, a memory of said plastic of said cap driving said projecting detent bead into said depression to form a leak-proof seal.

4. The urinal of claim 3 wherein said cap has a flat disk shaped diaphragm with a reinforced area in the center thereof, pressure on said reinforcing area deforming said diaphragm into a somewhat conical shape reducing the diameter of said projecting bead enough to slide through said neck, a release of said pressure on said reinforcing area causing said memory of said plastic to force said diaphragm to resume its flat disk shape driving said bead into said depression.

5. The urinal of claim 4 and a first lip on said cap for limiting the travel of said cap into said neck at a location which aligns said bead in confrontation with said depression.

6. The urinal of claim 4 and a lift tab projecting from a restricted area on said outside circumference of said cap, a lifting of said tab peeling said projecting bead out of said circumferential depression.

7. The urinal of claim 6 and a strap extending from said circumference of said cap at a point away from said lift tab, and a window in an outer end of said strap, said window fitting over said handle in order to connect said cap to said urinal.

8. The urinal of claim 4 and a tapered section between said detent bead and said diaphragm for guiding and directing said cap into said neck.

* * * * *